United States Patent [19]

Tanahashi

[11] 4,058,091

[45] Nov. 15, 1977

[54] INTERNAL COMBUSTION ENGINE OF A LEAN AIR-FUEL MIXTURE COMBUSTION TYPE

[75] Inventor: Toshio Tanahashi, Toyota, Japan

[73] Assignee: Toyota Jidosha Kogyo Kabushiki Kaisha, Japan

[21] Appl. No.: 692,504

[22] Filed: June 3, 1976

[30] Foreign Application Priority Data

Jan. 21, 1976 Japan ..... 51-5042

[51] Int. Cl.[2] ..... F02B 19/10; F02M 39/00

[52] U.S. Cl. ..... 123/32 VN; 123/188 VA; 123/32 ST; 123/139 R

[58] Field of Search ..... 123/32 VN, 32 SP, 75 B, 123/188 VA, 32 ST, 139 R

[56] References Cited

U.S. PATENT DOCUMENTS 2,072,437 3/1937 Wurtele ..... 123/32 VN 3,987,769 10/1976 Yew ..... 123/75 B

*Primary Examiner*—Ronald B. Cox

*Attorney, Agent, or Firm*—Stevens, Davis, Miller & Mosher

[57] ABSTRACT

An internal combustion engine of a lean air-fuel mixture combustion type comprising a valve guide and an intake valve supported by the valve guide. A pumping chamber is formed between the inner wall of the valve guide and the outer wall of the valve stem of the intake valve. The valve head has on its outer wall an injection nozzle connected to the pumping chamber. When the intake valve returns to its closing position at the time of the intake stroke, a fuel is injected from the injection nozzle into the combustion chamber filled with a lean air-fuel mixture whereby, a rich air-fuel mixture layer is formed in an ignition area around the spark gap of the spark plug.

7 Claims, 6 Drawing Figures

Fig. 3
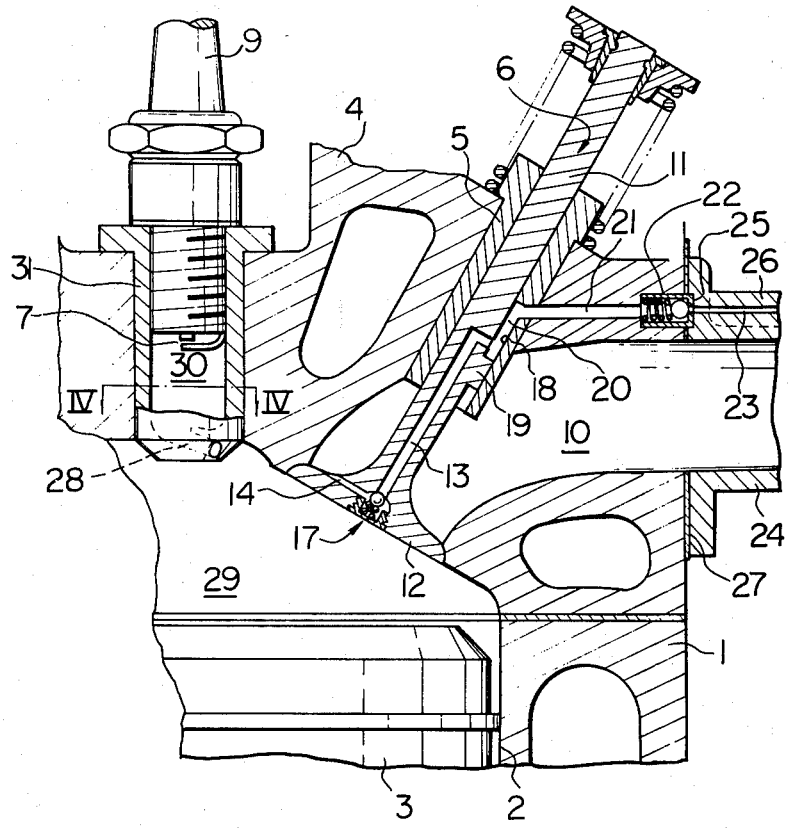
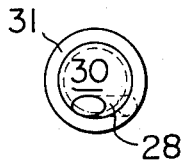
Fig. 4

INTERNAL COMBUSTION ENGINE OF A LEAN AIR-FUEL MIXTURE COMBUSTION TYPE

DESCRIPTION OF THE INVENTION

The present invention relates to an internal combustion engine of a lean air-fuel mixture combustion type, and particularly relates to an internal combustion engine of a lean air-fuel mixture combustion type in which a mixture in a combustion chamber is formed by two separate mixture layers comprising a lean air-fuel mixture layer and a rich air-fuel mixture layer, whereby the rich air-fuel mixture is ignited by a spark plug.

As a conventional method for simultaneously reducing the level of harmful components contained in exhaust gases from internal combustion engine, such as CO (carbon monoxide), HC (unburned hydrocarbons) and $NO_x$ (nitrogen oxides), there is known an effective method in which a lean air-fuel mixture having an increased air-fuel ratio (i.e., beyond the stoichiometric ratio) is used. This lean air-fuel mixture, however, is less easily ignited. In order to eliminate this disadvantage, an internal combustion engine has been proposed, in which a mixture in a combustion chamber is formed by two separate mixture layers comprising a lean air-fuel mixture layer and a rich air-fuel mixture layer, whereby the rich air-fuel mixture is ignited by a spark plug, thereby greatly improving the ease of the ignition and also reducing the level of harmful components in the exhaust gas. In order to form a rich air-fuel mixture layer in a combustion chamber, for example, there is known an internal combustion engine provided with fuel injection nozzles, in which a fuel is injected from the fuel injection nozzles directly to the combustion chamber, thereby forming a rich air-fuel mixture layer in the combustion chamber. However, an internal combustion engine of this type requires the provisions of expensive injection nozzles having durability to high temperature and high pressure, a complicated piping, and a plunger unit actuated precisely in synchronization with the revolution of the crankshaft of the engine. Consequently, an internal combustion engine of this type has a considerably more complicated construction.

An object of the present invention is to eliminate the above-mentioned drawback. That is to say, an object of the present invention is to provide an internal combustion engine in which a rich air-fuel mixture layer can be formed in the combustion chamber by using an extremely simple mechanism.

According to the present invention, an internal combustion engine comprises a cylinder block, a piston reciprocally movable in the cylinder block, a cylinder head fixed onto the cylinder block, a combustion chamber formed between the inner surface of the cylinder head and the top surface of the piston, a valve guide fixed to the cylinder head, an intake valve supported by the valve guide and comprising a valve stem and a valve head having on its outer wall an injection nozzle, an intake passage one end of which is connected to the combustion chamber via the intake valve, the other end of the intake passage being connected to the atmosphere, a fuel supply means for feeding a lean air-fuel mixture into the intake passage, a spark plug having gap located in the combustion chamber, a pumping chamber formed between the valve stem and the valve guide, the pumping operation of said pumping chamber being caused by the reciprocal movement of the intake valve, a fuel injection passage formed in the intake valve and arranged so as to connect the pumping chamber with the injection nozzle, a first check valve disposed in said fuel injection passage and only allowing outflow of a liquid fuel from the pumping chamber to the injection nozzle, a fuel supply passage arranged so as to connect the pumping chamber with a fuel source, a second check valve disposed in the fuel supply passage and only allowing inflow of the liquid fuel from the fuel source to the pumping chamber, said injection nozzle being arranged so as to be directed to an ignition area around the saprk gap, a fuel being injected from the injection nozzle into the combustion so as to form a rich air-fuel mixture layer in the ignition area when the intake valve returns to its closing position at the time of the intake stroke of the engine.

The above-mentioned object of the present invention may be more fully understood from the following descriptions of a preferred embodiment of the invention, together with the accompanying drawings.

BRIEF DESCRIPTION OF THE DRAWINGS

In the drawings:

FIG. 3 is a cross-sectional side view of the other embodiment according to the present invention;

FIG. 4 is a cross-sectional view taken along the line IV—IV in FIG. 3;

DESCRIPTION OF A PREFERRED EMBOIDMENT

Figure 1:
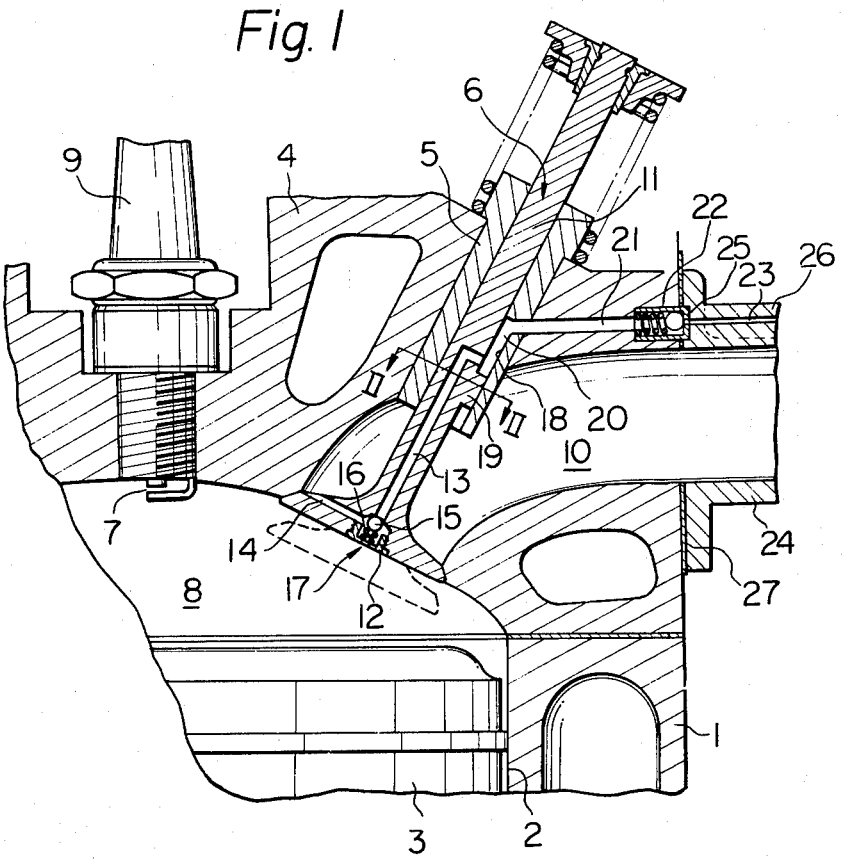
FIG. 1 is a cross-sectional side view of an internal combustion engine according to the present invention.
Figure 2:
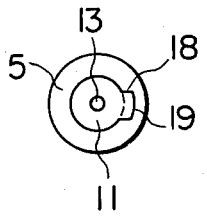
FIG. 2 is a cross-sectional view taken along the line II—II in FIG. 1.

FIG. 1 shows an internal combustion engine according to the present invention. Referring to FIG. 1, an internal combustion engine according to the present invention comprises a cylinder block 1, a piston 3 reciprocally movable in a cylinder 2 formed in the cylinder block 1, a cylinder head 4 fixed onto the cylinder block 1, an intake valve 6 supported by an intake valve stem guide 5 so as to be able to slide in the valve stem guide 5, an exhaust valve (not shown), a spark plug 9 screwed into the cylinder head 4 so that the spark gap of the spark plug 9 is located in a combustion chamber 8. A lean air-fuel mixture is introduced into the combustion chamber 8 via an intake port 10. As is known to the general public, the intake valve 6 comprises a valve stem 11 and a valve head 12. According to the present invention, a fuel delivery passage 13 extending in the axial direction of the valve stem 11 is formed in the valve stem 11, and a fuel injection passage 14 is formed in the valve head 12. The fuel delivery passage 13 and the fuel injection passage 14 are interconnected via a check valve 17 comprising a check ball 15 and a compression spring 16. The spring constant of the compression spring 16 of the check valve 17 is set such that, when the pressure of a liquid fuel in the fuel delivery passage 13 is elevated at a predetermined level, the check ball 15 opens the fuel delivery passage 13, whereby fuel in the delivery passage 13 is delivered into the fuel injection passage 14. A groove 18 extending in the longitudinal direction of the stem guide 5 and having a rectangular cross section is formed on the inner wall of the stem guide 5, and a projection 19 having a rectangular cross section is formed on the outer wall of the valve stem 11. This projection 19 is slidably fitted into the groove 18 as shown in FIG. 2. Thus, a pumping chamber 20 is formed by the projection 19, the groove 18 and the outer wall of the valve stem 11, the volume of the pumping chamber 20 being changed in accordance with movement of the intake valve 6. The pumping chamber 20 is connected to the fuel delivery passage 13, on one hand, and is connected to the float chamber of the carburetor (not shown) via a fuel conduit 21, a check valve 22 and a fuel conduit 23 on the other hand. One end of the check valve 22 projects from the outer wall of the cylinder head 4, and a recess 25 formed on the end face of the intake manifold 24 is fitted into the projected end of the check valve 22. Consequently, when the intake manifold 24 is fixed to the cylinder head 4 via a gasket 27 by means of, for example, balts (not shown), the check valve 22 serves to place the intake manifold 24 in a position. Furthermore, after fixing the intake manifold 24 onto the cylinder head 4, the check valve 22 also serves to prevent the intake manifold 24 from getting out of position. A rib 26 is formed in one piece on the outer periphery of the intake manifold 24, and the fuel conduit 23 is formed in the rib 26. Consequently, no piping is required for connecting the check valve 22 with the float chamber (not shown) of the carburetor, and thus the engine construction is an extremely simple one.

At the time of the intake stroke of the engine, the intake valve 6 opens and gradually moves downwards as the piston 3 moves downwards. At this time, a lean air-fuel mixture is introduced into the combustion chamber 8 from the intake port 10. On the other hand, a liquid fuel is fed into the pumping chamber 20 from the fuel conduit 23 via the check valve 22 due to the fact that the volume of the pumping chamber 20 increases as the intake valve 6 moves downwards. This feeding operation of the liquid fuel is continued until the intake valve 6 moves downwards to it's lowermost position. Then, as the intake valve 6 moves upwards, the volume of the pumping chamber 20 gradually decreases. At this time, the pressure of the liquid fuel in the pumping chamber 20 gradually increases because the check valve 22 is closed, and the check valve 17 is also closed by the spring force of the compression spring 16. When the intake valve 6 moves upwards at the position shown by the broken line and the pressure of the liquid fuel in the pumping chamber 20 is elevated at a predetermined level, the check valve 17 opens and, thus, the liquid fuel in the pumping chamber 20 is injected into the combustion chamber 8 via the fuel delivery passage 13, the check valve 17 and the fuel injection passage 14. As is shown in FIG. 1, the fuel injection passage 14 is directed to the spark gap 7 of the spark plug 9. Accordingly, the fuel injected into the combustion chamber 8 from the fuel injection passage 14 forms a rich air-fuel mixture layer around the spark gap 7 of the spark plug 9, and then the rich air-fuel mixture is ignited by the spark plug 9.

In the embodiment shown in FIG. 1, the rotation of the intake valve 6 is prevented by fitting the projection 19 into the groove 20, whereby the fuel injection passage 14 can always be directed to the spark gap 7 of the spark plug 9.

FIG. 3 shows the other embodiment according to the present invention. In FIG. 3, similar components are indicated with the same reference numerals in FIG. 1. The components of the embodiment shown in FIG. 3 are different from those of the embodiment shown in FIG. 1 only in the points where a combustion chamber comprises a main combustion chamber 29 and a subsidiary combustion chamber 30, the chambers 29 and 30 being interconnected via a connecting passage 28, and the spark gap 7 of the spark plug 9 is located in the subsidiary combustion chamber 30. It is apparent from FIG. 3, the subsidiary combustion chamber 30 and the connecting passage 28 are formed in a cylindrical hollow member 31 fixed to the cylinder head 4. As is shown in FIG. 4, the connecting passage 28 is arranged so as to extend in a tangential direction of the cylindrical inner wall of the cylindrical hollow member 31 so as to be directed to the intake valve 6.

Consequently, a fuel injected from the fuel injection passage 14 of the intake valve 6 is introduced into the subsidiary combustion chamber 30 via the connecting passage 28 and, thus, a rich air-fuel mixture layer is formed in the subsidiary combustion chamber 30. When the fuel is introduced into the subsidiary combustion chamber 30, this fuel is turned along the cylindrical inner wall of the cylindrical hollow member 31 since the connecting passage 28 is arranged so as to extend in a tangential direction of the cylindrical inner wall of the cylindrical hollow member 31 as is hereinbefore mentioned. At this time, the turning flow of the fuel in the subsidiary combustion chamber 30 causes a residual gas left around the spark gap 7 of the spark plug 9 to be removed, whereby the rich air-fuel mixture in the subsidiary combustion chamber 30 can be easily ignited. The combustion gas of the ignited rich air-fuel mixture is injected into the main combustion chamber 29 from the connecting passage 28 and then this injected combustion gas causes a lean air-fuel mixture in the main combustion chamber 29 to be fired.

Figure 5:
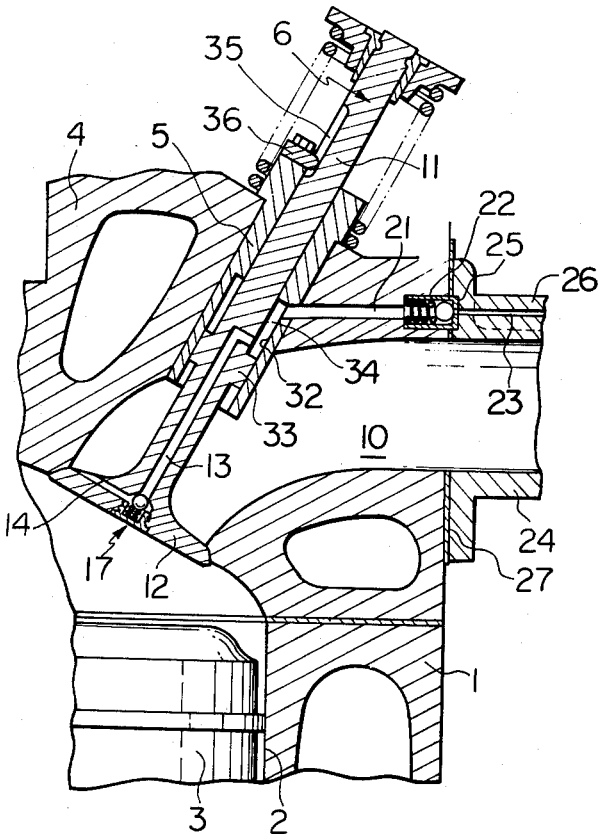
FIG. 5 is a cross-sectional view of a further embodiment according to the present invention.

FIG. 5 shows the other embodiment of FIGS. 1 and 3. Referring to FIG. 5, a cylindrical groove 32 is formed on the inner wall of the valve stem guide 5 while, on the other hand, an annular projection 33 is formed on the outer wall of the valve stem 11. Thus, a pumping chamber 34 is formed by the cylindrical groove 32 and the annular projection 33. In this case, in order to prevent the rotation of the intake valve 6, an axially extending groove 35 is formed on the outer wall of the valve stem 11 and a pawl member 36 fixed onto the upper end of the valve stem guide 5 is engaged with the axially extending groove 35.

Figure 6:
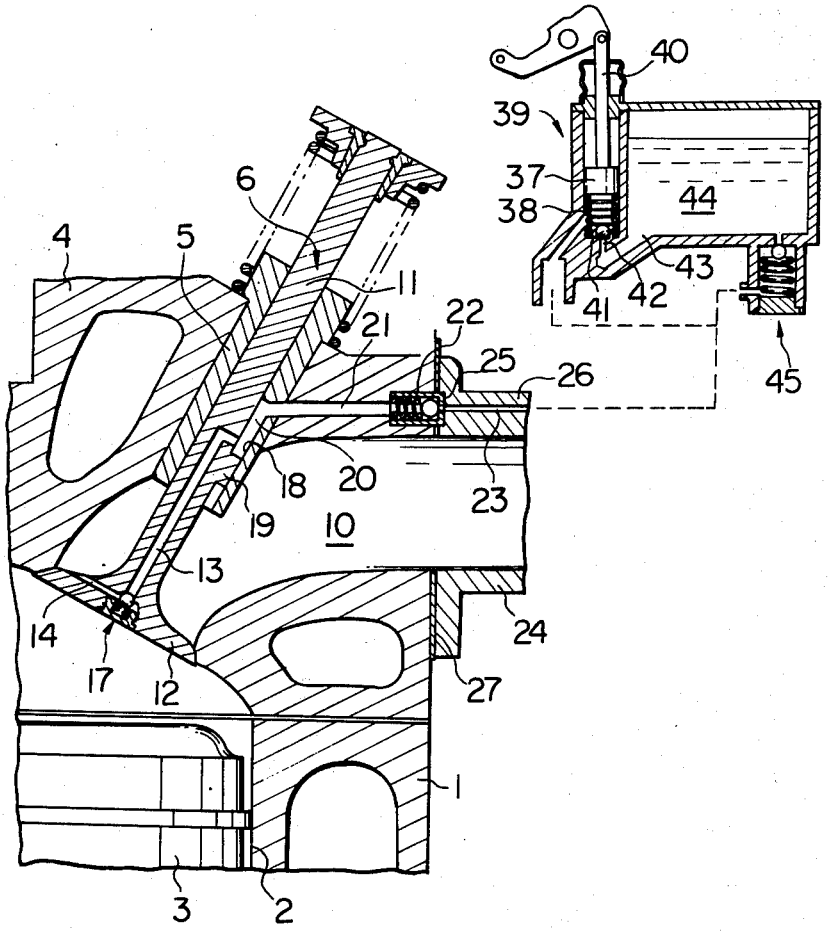
FIG. 6 is a cross-sectional view of a still further embodiment according to the present invention.

FIG. 6 shows a further embodiment of FIGS. 1 and 3. Referring to FIG. 6, an internal combustion engine is provided with an accelerator pump 39 comprising a piston 37 and a compression chamber 38. The piston 37 is connected to an accelerator pedal (not shown) via a piston rod 40 so that the depression of the accelerator pedal causes the piston 37 to move downwards. The compression chamber 38 is connected to a float chamber 44 of the carburetor via a check ball 41 and conduits 42 and 43. The fuel conduit 23 is connected to the compression chamber 38, on one hand, and to the float chamber 44 via a check valve 45, on the other hand.

Consequently, when the accelerator pedal is depressed, the piston 37 is moved downwards, whereby the liquid fuel in the compression chamber 38 is pressed and delivered into the pumping chamber 20 via the check valve 22. Thus, the pressure of the liquid fuel in the pumping chamber 20 increase to a higher level compared with the case where the accelerator pump 39 is not being operated. Consequently, at the time of the intake stroke, the check valve 17 opens as soon as the intake valve 6 begins to move upwards after the intake valve 6 moves downwards, whereby a larger amount of fuel is injected into the combustion chamber 8, compared with the case where the accelerator pump 39 is not being operated.

According to the present invention, it will be understood that the following various effects are advantageously provided.

i. The manufacturing cost of the engine is very low because expensive injection nozzles such as conventional injection nozzles are not required for the engine.

ii. There is no need of providing a fuel feed pump because a pumping operation is created by the motion of the intake valve.

iii. A precise injection timing of a fuel can always be obtained because the injecting operation of the fuel is caused by the motion of the intake valve per se.

iv. Since fuel is injected from the intake valve only when the intake valve returns to a closing position, no fuel is injected at the duration of overlap during which both the intake valve and the exhaust valve open. Consequently, there is no danger of unburned fuel being delivered into the exhaust system of the engine.

v. By connecting the pumping chamber with the accelerator pump of the carburetor, a large amount of fuel is rapidly and uniformly fed into each cylinder at the time of acceleration, thus preventing a misfire caused by a lack of fuel, which occurs when the accelerator pedal is depressed, thereby improving the acceleration performance.

vi. When the engine is stopped, fuel injection from the fuel injection passage of the intake valve can be completely prevented by the action of the check valve.

What is claimed is:

1. An internal combustion engine of a lean air-fuel mixture combustion type, comprising:

a cylinder block, a piston reciprocally movable in the cylinder block, a cylinder head fixed onto the cylinder block, a combustion chamber formed between the inner surface of the cylinder head and the top surface of the piston, a valve guide fixed to the cylinder head, an intake valve supported by the valve guide and comprising a valve stem and a valve head having on its outer wall an injection nozzle, an intake passage one end of which is connected to the combustion chamber via the intake valve, the other end of the intake passage being connected to the atmosphere, a fuel supply means for feeding a lean air-fuel mixture into the intake passage, a spark plug having a spark gap located in the combustion chamber, a pumping chamber formed between the valve stem and the valve guide, the pumping operation of said pumping chamber being caused by the reciprocal movement of the intake valve, a fuel injection passage formed in the intake valve and arranged so as to connect the pumping chamber with the injection nozzle, a first check valve disposed in said fuel injection passage and only allowing outflow of a liquid fuel from the pumping chamber to the injection nozzle, a fuel supply passage arranged so as to connect the pumping chamber with a fuel source, a second check valve disposed in the fuel supply passage and only allowing inflow of the liquid fuel from the fuel source to the pumping chamber, said injection nozzle being arranged so as to be directed to an ignition area around the spark gap, a fuel being injected from the injection nozzle into the combustion so as to form a rich air-fuel mixture layer in the ignition area when the intake valve returns to its closing position at the time of the intake stroke of the engine, said pumping chamber comprising a groove formed on the valve guide and a projection formed on the valve stem, said projection being fitted into said groove.

2. An internal combustion engine of a lean air-fuel mixture combustion type, comprising:

a cylinder block, a piston reciprocally movable in the cylinder block, a cylinder head fixed onto the cylinder block, a combustion chamber formed between the inner surface of the cylinder head and the top surface of the piston, a valve guide fixed to the cylinder head, an intake valve supported by the valve guide and comprising a valve stem and a valve head having on its outer wall an injection nozzle, an intake passage one end of which is connected to the combustion chamber via the intake valve, the other end of the intake passage being connected to the atmosphere, a fuel supply means for feeding a lean air-fuel mixture into the intake passage, a spark plug having a spark gap located in the combustion chamber, a pumping chamber formed between the valve stem and the valve guide, the pumping operation of said pumping chamber being caused by the reciprocal movement of the intake valve, a fuel injection passage formed in the intake valve and arranged so as to connect the pumping chamber with the injection nozzle, a first check valve disposed in said fuel injection passage and only allowing outflow of a liquid fuel from the pumping chamber to the injection nozzle, a fuel supply passage arranged so as to connect the pumping chamber with a fuel source, a second check valve disposed in the fuel supply passage and only allowing inflow of the liquid fuel from the fuel source to the pumping chamber, said injection nozzle being arranged so as to be directed to an ignition area around the spark gap, a fuel being injected from the injection nozzle into the combustion so as to form a rich air-fuel mixture layer in the ignition area when the intake valve returns to its closing position at the time of the intake stroke of the engine, said pumping chamber comprising a groove formed on the valve guide and a projection formed on the valve stem, said projection being fitted into said groove, said projection and said groove having rectangular cross-sections, respectively.

3. An internal combustion engine of a lean air-fuel mixture combustion type, comprising:

a cylinder block, a piston reciprocally movable in the cylinder block, a cylinder head fixed onto the cylinder block, a combustion chamber formed between the inner surface of the cylinder head and the top surface of the piston, a valve guide fixed to the cylinder head, an intake valve supported by the valve guide and comprising a valve stem and a valve head having on its outer wall an injection nozzle, an intake passage one end of which is connected to the combustion chamber via the intake valve, the other end of the intake passage being connected to the atmosphere, a fuel supply means for feeding a lean air-fuel mixture into the intake passage, a spark plug having a spark gap located in the combustion chamber, a pumping chamber formed between the valve stem and the valve guide, the pumping operation of said pumping chamber being caused by the reciprocal movement of the intake valve, a fuel injection passage formed in the intake valve and arranged so as to connect the pumping chamber with the injection nozzle, a first check valve disposed in said fuel injection passage and only allowing outflow of a liquid fuel from the pumping chamber to the injection nozzle, a fuel supply passage arranged so as to connect the pumping chamber with a fuel source, a second check valve disposed in the fuel supply passage and only allowing inflow of the liquid fuel from the fuel source to the pumping chamber, said injection nozzle being arranged so as to be directed to an ignition area around the spark gap, a fuel being injected from the injection nozzle into the combustion so as to form a rich air-fuel mixture layer in the ignition area when the intake valve returns to its closing position at the time of the intake stroke of the engine, said pumping chamber comprising a groove formed on the valve guide and a projection formed on the valve stem, said projection being fitted into said groove, said projection having an annular shape and said groove having an annular cross-section.

4. An internal combustion engine of a lean air-fuel mixture combustion type, comprising:

a cylinder block, a piston reciprocally movable in the cylinder block, a cylinder head fixed onto the cylinder block, a combustion chamber formed between the inner surface of the cylinder head and the top surface of the piston, a valve guide fixed to the cylinder head, an intake valve supported by the valve guide and comprising a valve stem and a valve head having on its outer wall an injection nozzle, an intake passage one end of which is connected to the combustion chamber via the intake valve, the other end of the intake passage being connected to the atmosphere, a fuel supply means for feeding a lean air-fuel mixture into the intake passage, a spark plug having a spark gap located in the combustion chamber, a pumping chamber formed between the valve stem and the valve guide, the pumping operation of said pumping chamber being caused by the reciprocal movement of the intake valve, a fuel injection passage formed in the intake valve and arranged so as to connect the pumping chamber with the injection nozzle, a first check valve disposed in said fuel injection passage and only allowing outflow of a liquid fuel from the pumping chamber to the injection nozzle, a fuel supply passage arranged so as to connect the pumping chamber with a fuel source, a second check valve disposed in the fuel supply passage and only allowing inflow of the liquid fuel from the fuel source to the pumping chamber, said injection nozzle being arranged so as to be directed to an ignition area around the spark gap, a fuel being injected from the injection nozzle into the combustion so as to form a rich air-fuel mixture layer in the ignition area when the intake valve returns to its closing position at the time of the intake stroke of the engine, said combustion chamber comprising a main combustion chamber and a subsidiary combustion chamber, said chambers being interconnected via a connecting passage arranged so as to be directed to the intake valve for receiving a fuel injected from the injection nozzle into the subsidiary combustion chamber, the spark gap of the spark plug being located in the subsidiary combustion chamber, and said connecting passage being arranged so as to extend in a tangential direction with respect to the inner wall defining the subsidiary combustion chamber.

5. An internal combustion engine of a lean air-fuel mixture combustion type, comprising:

a cylinder block, a piston reciprocally movable in the cylinder block, a cylinder head fixed onto the cylinder block, a combustion chamber formed between the inner surface of the cylinder head and the top surface of the piston, a valve guide fixed to the cylinder head, an intake valve supported by the valve guide and comprising a valve stem and a valve head having on its outer wall an injection nozzle, an intake passage one end of which is connected to the combustion chamber via the intake valve, the other end of the intake passage being connected to the atmosphere, a fuel supply means for feeding a lean air-fuel mixture into the intake passage, a spark plug having a spark gap located in the combustion chamber, a pumping chamber formed between the valve stem and the valve guide, the pumping operation of said pumping chamber being caused by the reciprocal movement of the intake valve, a fuel injection passage formed in the intake valve and arranged so as to connect the pumping chamber with the injection nozzle, a first check valve disposed in said fuel injection passage and only allowing outflow of a liquid fuel from the pumping chamber to the injection nozzle, a fuel supply passage arranged so as to connect the pumping chamber with a fuel source, a second check valve disposed on the fuel supply passage and only allowing inflow of the liquid fuel from the fuel source to the pumping chamber, said injection nozzle being arranged so as to be directed to an ignition area around the spark gap, a fuel being injected from the injection nozzle into the combustion so as to form a rich air-fuel mixture layer in the ignition area when the intake valve returns to its closing position at the time of the intake stroke of the engine, said internal combustion engine also including an accelerator pump associated with an accelerator pedal, wherein a third check valve is disposed in the fuel supply passage between the second check valve and the fuel source, said third check valve only allowing outflow of the liquid fuel from the fuel source to the fuel supply passage, and the accelerator pump being connected to the fuel supply passage between the second check valve and the third check valve so as to inject a large amount of fuel into the combustion chamber at the time of acceleration.

6. An internal combustion engine of a lean air-fuel mixture combustion type, comprising:

a cylinder block, a piston reciprocally movable in the cylinder block, a cylinder head fixed onto the cylinder block, a combustion chamber formed between the inner surface of the cylinder head and the top surface of the piston, a valve guide fixed to the cylinder head an intake valve supported by the valve guide and comprising a valve stem and a valve head having on its outer wall an injection nozzle, an intake passage one end of which is connected to the combustion chamber via the intake valve, the other end of the intake passage being connected to the atmosphere, a fuel supply means for feeding a lean air-fuel mixture into the intake passage, a spark plug having a spark gap located in the combustion chamber, a pumping chamber formed between the valve stem and the valve guide, the pumping operation of said pumping chamber being caused by the reciprocal movement of the intake valve, a fuel injection passage formed in the intake valve and arranged so as to connect the pumping chamber with the injection nozzle, a first check valve disposed in said fuel injection passage and only allowing outflow of a liquid fuel from the pumping chamber to the injection nozzle, a fuel supply passage arranged so as to connect the pumping chamber with a fuel source, a second check valve disposed in the fuel supply passage and only allowing inflow of the liquid fuel from the fuel source to the pumping chamber, said injection nozzle being arranged so as to be directed to an ignition area around the spark gap, a fuel being injected from the injection nozzle into the combustion so as to form a rich air-fuel mixture layer in the ignition area when the intake valve returns to its closing position at the time of the intake stroke of the engine, said internal combustion engine also including an intake manifold, wherein a rib is formed in one piece on the outer wall of the intake manifold, and the fuel supply passage is formed in said rib.

7. An internal combustion engine of a lean air-fuel mixture combustion type, comprising:

a cylinder block, a piston reciprocally movable in the cylinder block, a cylinder head fixed onto the cylinder block, a combustion chamber formed between the inner surface of the cylinder head and the top surface of the piston, a valve guide fixed to the cylinder head, an intake valve supported by the valve guide and comprising a valve stem and a valve head having on its outer wall an injection nozzle, an intake passage one end of which is connected to the combustion chamber via the intake valve, the other end of the intake passage being connected to the atmosphere, a fuel supply means for feeding a lean air-fuel mixture into the intake passage, a spark plug having a spark gap located in the combustion chamber, a pumping chamber formed between the valve stem and the valve guide, the pumping operation of said pumping chamber being caused by the reciprocal movement of the intake valve, a fuel injection passage formed in the intake valve and arranged so as to connect the pumping chamber with the injection nozzle, a first check valve disposed in said fuel injection passage and only allowing outflow of a liquid fuel from the pumping chamber to the injection nozzle, a fuel supply passage arranged so as to connect the pumping chamber with a fuel source, a second check valve disposed in the fuel supply passage and only allowing inflow of the liquid fuel from the fuel source to the pumping chamber, said injection nozzle being arranged so as to be directed to an ignition area around the spark gap, a fuel being injected from the injection nozzle into the combustion so as to form a rich air-fuel mixture layer in the ignition area when the intake valve returns to its closing position at the time of the intake stroke of the engine, the outer end of said second check valve projecting from the outer wall of the cylinder head, and a recess being formed on the end face of the intake manifold, said outer end of the second check valve being fitted into said recess so as to place the intake manifold in operational position.

* * * * *